United States Patent [19]

Laska

[11] Patent Number: 4,966,332

[45] Date of Patent: Oct. 30, 1990

[54] MEAT CHOPPER

[75] Inventor: Herbert Laska, Linz, Austria

[73] Assignee: Maschinenfabrik Laska Gesellschaft m.b.H., Austria

[21] Appl. No.: 261,054

[22] Filed: Oct. 21, 1988

[30] Foreign Application Priority Data

Oct. 21, 1987 [DE] Fed. Rep. of Germany ..... 3735651

[51] Int. Cl.[5] ..... B02C 18/16

[52] U.S. Cl. ..... 241/199.7; 241/199.12; 241/292; 241/292.1

[58] Field of Search ..... 241/199.12, 199.9, 199.11, 241/292, 287, 292.1, 282.1, 282.2, 199.7

[56] References Cited

U.S. PATENT DOCUMENTS 4,211,371 7/1980 Hotimsky ..... 241/292 X
4,407,458 10/1983 Hotimsky ..... 241/292 X

FOREIGN PATENT DOCUMENTS 286810 12/1970 Austria .
1757972 5/1972 Fed. Rep. of Germany .
7604618 3/1978 Fed. Rep. of Germany .
2653335 6/1978 Fed. Rep. of Germany .
2836630 3/1980 Fed. Rep. of Germany .
2900803 7/1980 Fed. Rep. of Germany .
3012595 10/1981 Fed. Rep. of Germany .
3518530 11/1986 Fed. Rep. of Germany .
2567421 1/1986 France ..... 241/199.12

*Primary Examiner*—Mark Rosenbaum
*Attorney, Agent, or Firm*—Andrus, Sceales, Starke & Sawall

[57] ABSTRACT

A meat chopper comprises a rotatable round pan and a rotatable cutter head with at least one cutter head unit. The cutter head unit comprises a base disk, at least one rotatable adjusting disk which is adjustable with respect to the base disk, and two therebetween cutters arranged diametrically. As the cutter head rotates, the cutters run radially in the basin of the round pan, while a certain distance to the round pan wall must be maintained. For this purpose, the cutters of each cutter head unit are pivotably supported at the base disk and positively locked to the adjusting disk by means of a follower device. The cutters of each cutter head unit are pressed together, and thus secured positively, in the set position with a respective lock nut. The adjusting disk can be positively locked by means of at least one locking device operable from the outside to facilitate changing or adjusting the cutters while reducing tooling costs.

21 Claims, 8 Drawing Sheets

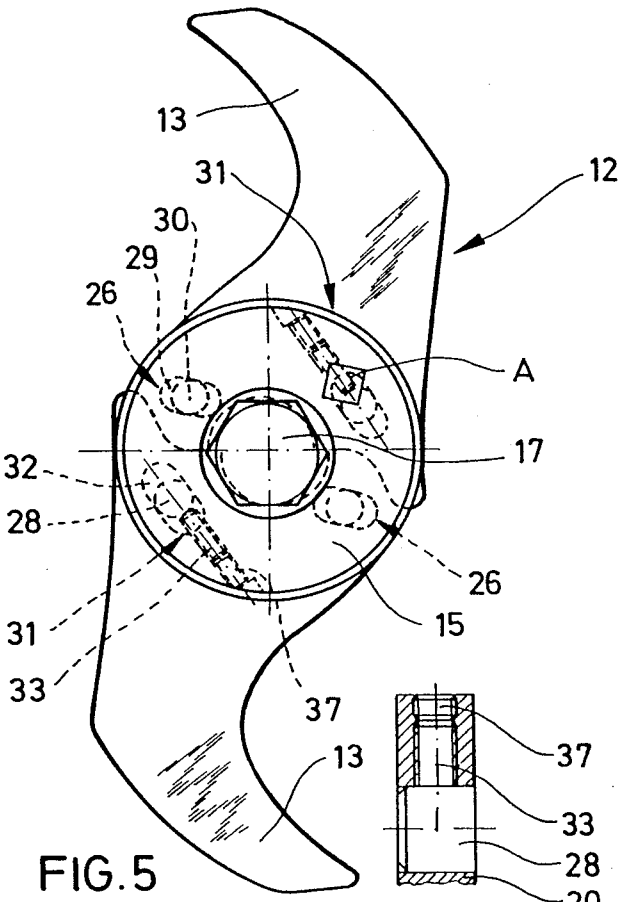
FIG. 5
FIG. 6
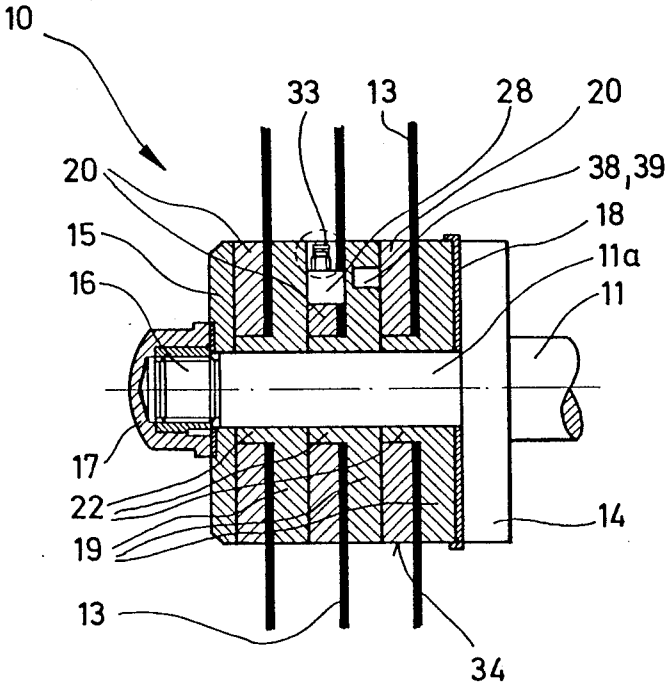
FIG. 4

FIG. 7A
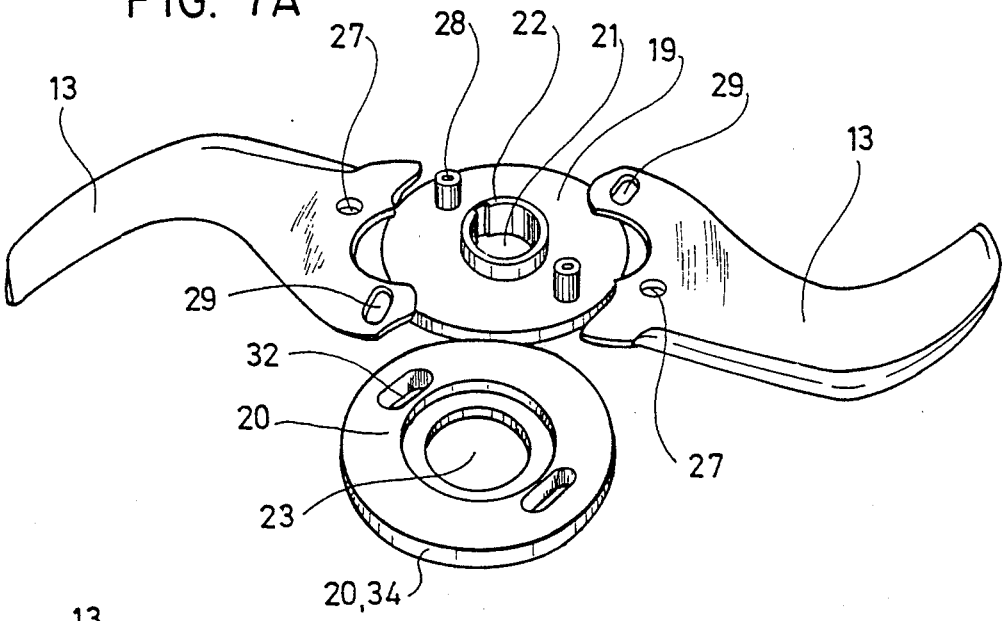
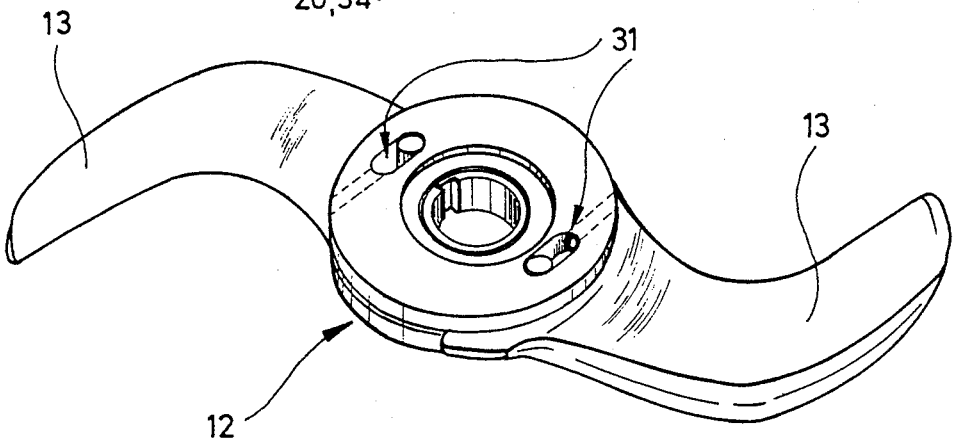
FIG. 7B

MEAT CHOPPER

The invention concerns a meat chopper with a round pan, which pan has a circular cross-section and can be rotated in an essentially horizontal plane. The meat chopper has at least one cutter head, which is attached in a non-rotatable and axially immovable manner to an essentially horizontal, rotatable shaft. The cutter head unit has at least one cutter head unit, which cutter head unit has a base disk, at least one adjusting disk which can be adjusted by rotating with respect to the base disk, and at least two cutters for interaction with the wall of the round pan. The cutters can be attached, axially and radially immovable, between the disks, each of which has one through-hole for the shaft. For the purpose of radial adjustment and the regulating of the distance with respect to the wall of the round pan, the cutters are pivotally arranged in their plane, about a pivot in the bearing device, and they can be coupled positively with the adjusting disk by means of a follower device, spaced from the respective pivot.

Meat choppers of this type, as they are known, for example, from AT-PS 286 810, are used for the fine-chopping of meat. In order to achieve a particular degree of fine-chopping, it is necessary that a certain distance between the round pan wall and the cutters interacting with it be set and maintained. However, wear and similar phenomena cause an increase in this distance, so that it has to be periodically readjusted.

For this purpose, a positively locking follower device is provided, which consists of a slotted hole in the respective cutter and a pin at the adjusting disk, which pin engages this through-hole when the cutter-unit is assembled. The elongated through-hole runs along a round boring, which is concentric with the pivot of the bearing device. In order to set the distance of the cutter from the round pan wall, the adjusting disk is rotatably adjusted with respect to the base disk. The pin, which engages the elongated through-holes in the cutters, transfers the adjusting movement to the cutters, causing them to be swivelled around the pivots of the bearing device. This alters the radius of the cutter point circle of movement, so that the cutter points can be adjusted to the desired distance from the round pan wall.

The cutters are secured in the position adjusted in this manner by positive locking at the two disks by means of a lock nut, which presses the adjusting disk, and thus the cutters, to the base disk. The very high cutting speeds of up to 130 m per second and the related stresses require a separate lock nut for each cutter head unit in order to secure the cutters adequately.

The positive locking of the cutters is disadvantageous because the cutter gripping surfaces facing the disks, as well as the respective gripping surfaces of the disks, must be constructed plane and parallel to one another, which results in relatively high tooling costs.

Furthermore, the time required for each adjustment of the cutter head, i.e. for a cutter change or a cutter adjustment, is disproportionately long, since each time the lock nut for each cutter must be loosened and tightened again. This requires careful attention, since the lock nuts must be tightened with a certain amount of torque so that, on the one hand, sufficient frictional connection is obtained between the disks and the cutters and, on the other hand, to prevent the thread from being torn out.

It is the object of the invention to improve a meat chopper the above mentioned type in such a way that, with reduced tooling costs, the cutter head, or the cutter head units, respectively, can be quickly exchanged or adjusted while at the same time a safe lock-in of the set cutter position is assured The invention attains its objective in that the adjusting disk can be positively locked to the base disk by means of at least one externally operable locking device.

Now, in the meat chopper of the invention, under the high stresses occurring during operation, each cutter is positively locked via the follower device to the adjusting disk, which in turn, is positively locked via the locking device to the base disk, which is mounted non-rotatably on the shaft. In their respective set position, the cutters are affixed by positive locking alone. The positive locking of the cutter position is eliminated as is, consequently, the need for the high pressing force on the adjusting disk previously exerted by means of the lock nut, so that now a single nut suffices for several cutter head units, for example, three to four units. Essentially, cutters can now be exchanged or adjusted more quickly and easily. At the same time tooling costs are reduced, since the requirements for plane and parallel gripping surfaces on cutters and disks are considerably less.

According to an advantageous embodiment, the locking device has at least one projection at one of the disks and one slotted hole in the respective other disk to accept the projection, as well as at least one locking element for engagement with the slotted hole for positive support of the projection at the respective other disk The slotted hole can extend through the thickness of the respective disk so that locking blocks, for example, can be inserted into the slotted hole from the outside in such a way that the projection is locked at a certain position in the slotted hole.

Preferably, the slotted hole is located in the adjusting disk, and the projection is located on the base disk.

An especially simple construction results if the pivot of the bearing device serves simultaneously as the projection of the locking device.

Two locking devices, approximately located diametrically to each other, can be provided. In this way, they can be designed as contra-rotating and thus unidirectional locking devices.

Preferably, the locking device is designed to serve simultaneously to turn the adjusting disk. Here, it is practical to construct the locking element as a locking and adjusting pin which can be screwed into a boring with internal thread extending from the outer circumferential edge of the respective disk to the slotted hole. In this way, it is possible, without removing the cutters of all cutter head units belonging to a cutter head from the shaft, to adjust them in an infinitely variable and very precise manner and to lock them securely. The lock nut merely has to be loosened or tightened lightly.

The adjustment of the cutters can be especially easy if the locking and adjusting pin is designed as a screw with a hexagonal recessed hole. Using a counter screw, preferably also having a hexagonal recessed hole, prevents any unintentional change in cutter position.

According to another advantageous embodiment, the locking device consists of a multiplicity of boreholes through one of the disks, at least one counter-boring and/or at least one slotted hole which is nonconcentric to the through-hole for the shaft, and has a width corresponding to the boreholes and counter-boring or the slot, respectively. With a corresponding number and position of the through-holes, for example, with differing distances from the disk center and especially with the use of the slotted hole, preferably a radial slotted hole, a hearly infinitely variable adjustment of the cutters can be made possible. Likewise, nearly infinitely variable adjustment results from using several counterborings, which are placed at varying tangential distance from each other.

Since fundamentally only one locking pin is required to lock the adjusting disk to the base, the remaining borings can serve as receptacles for balancing weights. Of course, pocket boreholes, accessible from the outside, can also be used for the balancing weights.

In order to permit the use of balancing weights having essentially the same mass, the pocket boreholes and/or at least part of the through-holes are located on a circular line near the edge of the disk.

It is advantageous to design the balancing weights and/or the locking pin as screwpin(s) and at least the through-holes and/or the pocket boreholes as tapholes for the screw pins.

In the meat chopper of the invention, the cutters of each cutter head unit can be placed in a radial plane, but also in two mutually parallel radial planes in order to improve feed-in of the material to be chopped.

The cutters of each cutter head unit can be adjusted separately if they are placed on both sides of the base disk with a respective adjusting disk.

In the following, a preferred version of the invention is described in greater detail with reference to the drawing.

The drawing shows:

FIG. 4 is a longitudinal section of the cutter had according to FIG. 2, but with only three cutter head units;

FIG. 5 is a view of the cutter head according to FIG. 4 in the direction of the shaft;

FIG. 6 is an enlarged sectional view of the part designated as "A'" in FIG. 5;

Figure 3:
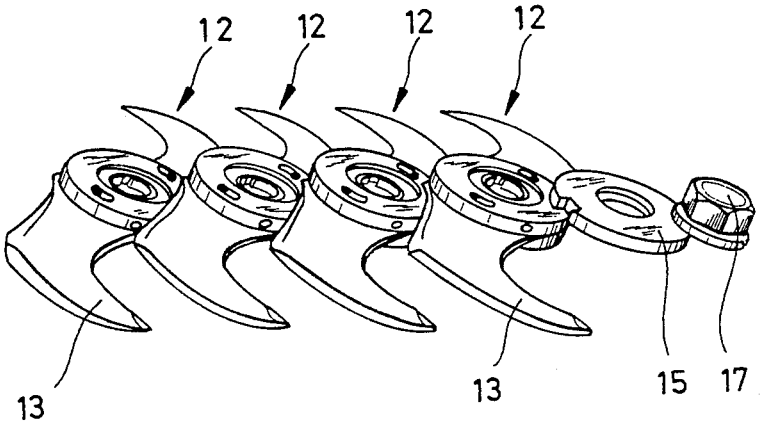
FIG. 3 is a perspective view of the cutter head units of the cutter head according to FIG. 2 removed from the shaft.
Figure 8:
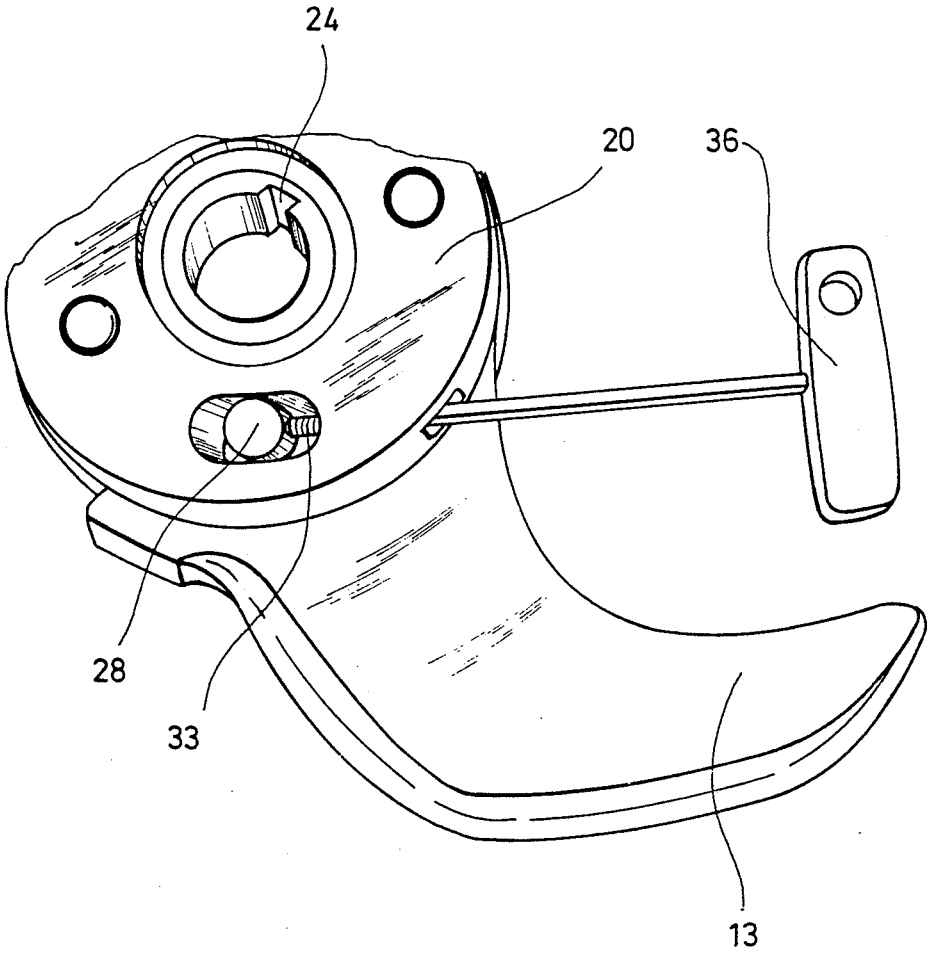
Figure 10:
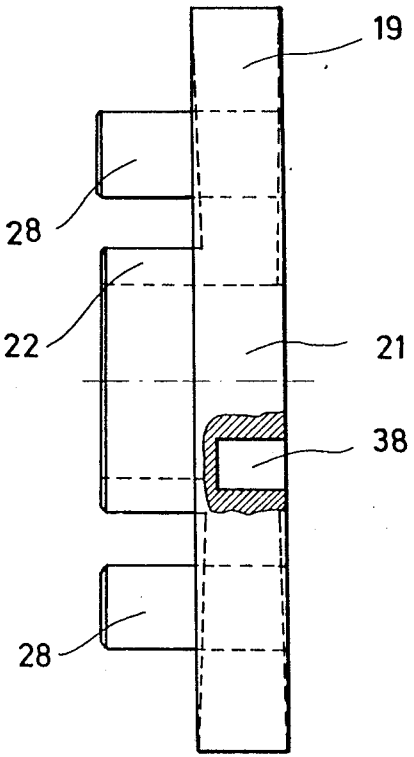
Figure 9:
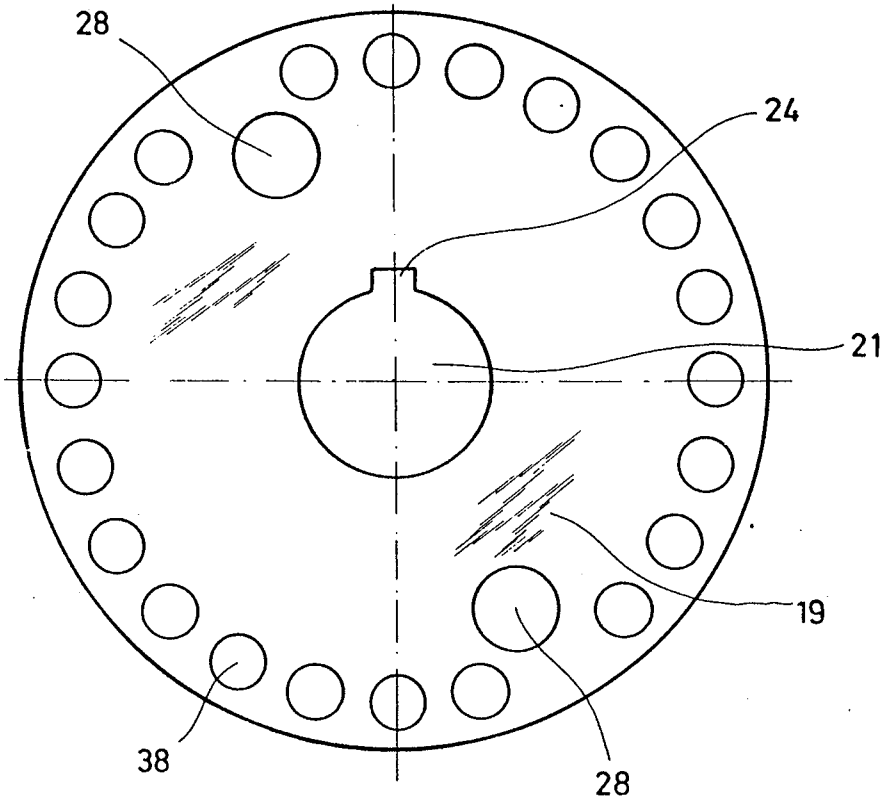
Figure 12:
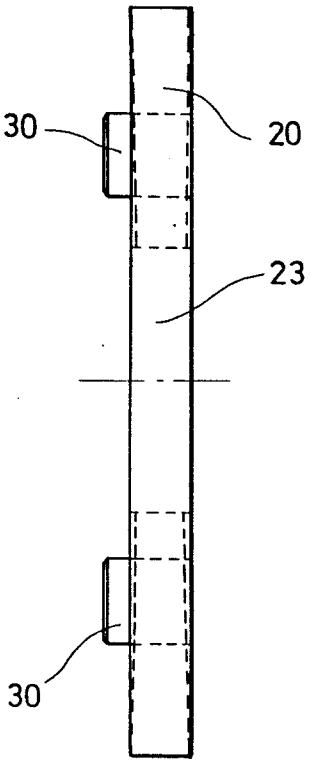
Figure 11:
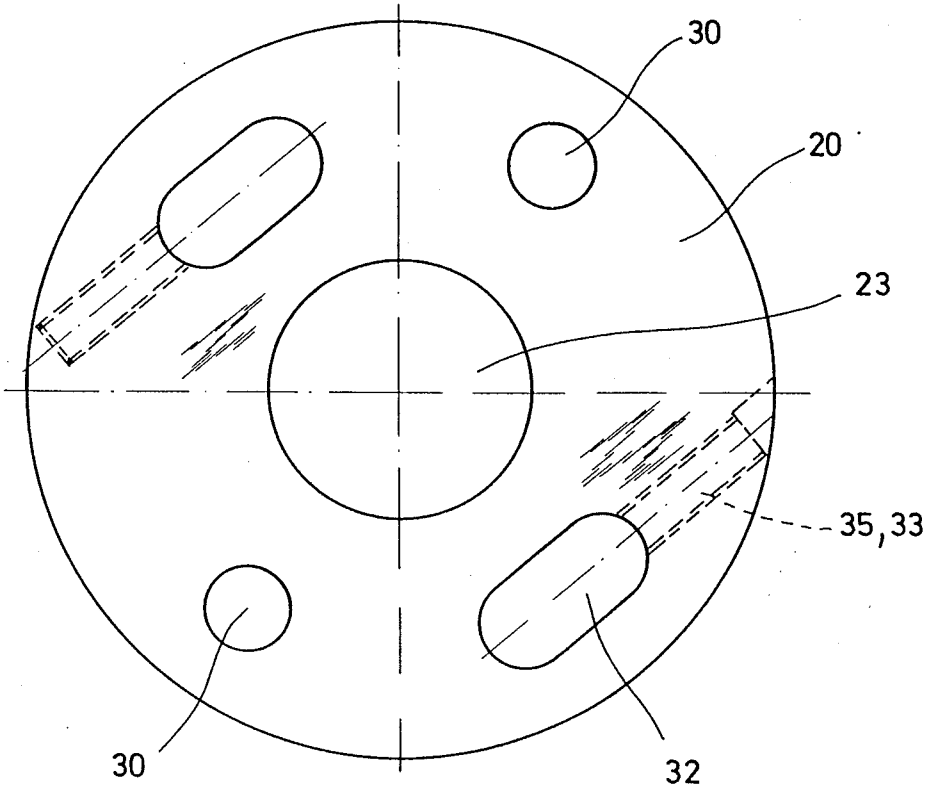
Figure 13:
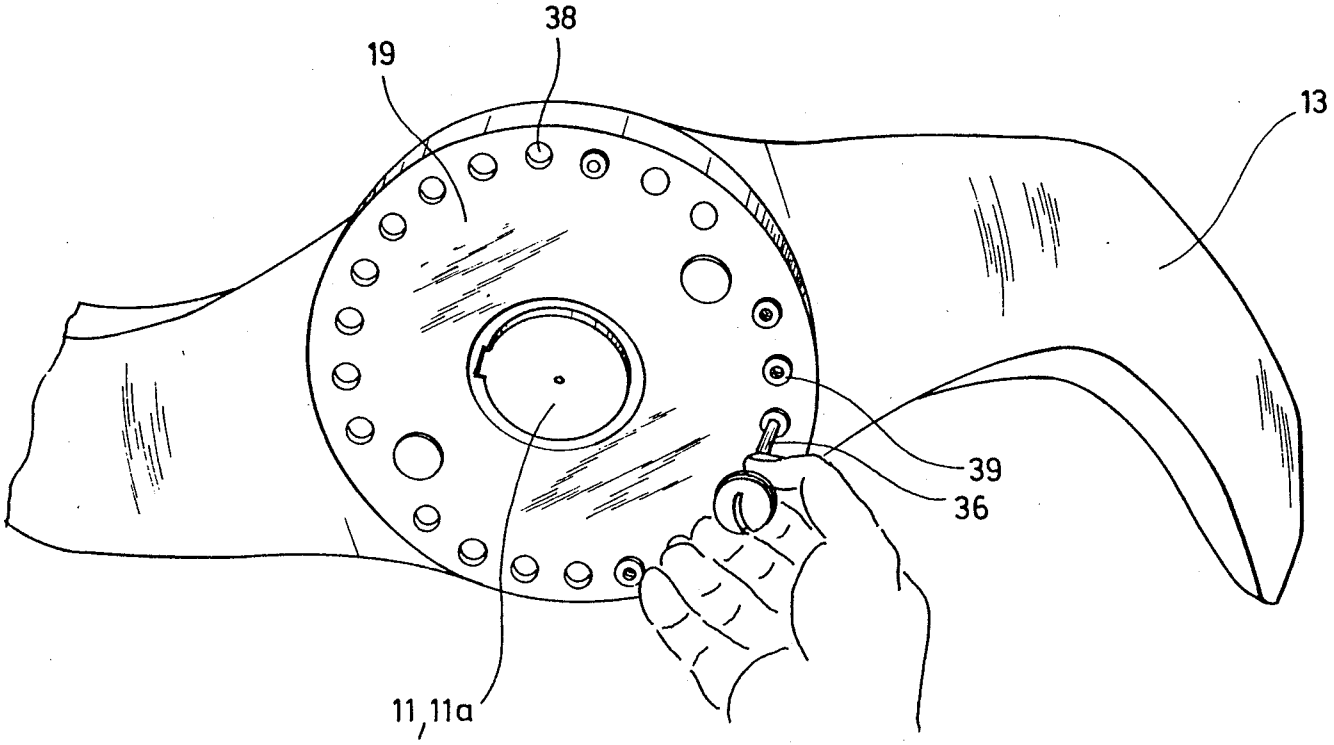

FIG. 7*a* is a perspective view of the components of the cutter head unit shown in FIG. 3 in the disassembled state;

FIG. 7*b* is a perspective view of the components of the cutter head unit shown in FIG. 3 in the assembled state;

FIG. 8 is an enlarged perspective view of the locking device of the cutter head unit shown in FIG. 7, with adjusting tool;

FIG. 9 is a plan view of the base disk of the cutter head unit shown in FIG. 5;

FIG. 10 is a lateral view of the base disk according to FIG. 9;

FIG. 11 is a plan view of the adjusting disk of the cutter head unit shown in FIG. 5;

FIG. 12 is a lateral view of the adjusting disk according to FIG. 11; and FIG. 13 is a perspective view of one of the cutter head units accordign to FIG. 3, with balancing weights on the base disk.

Figure 1:
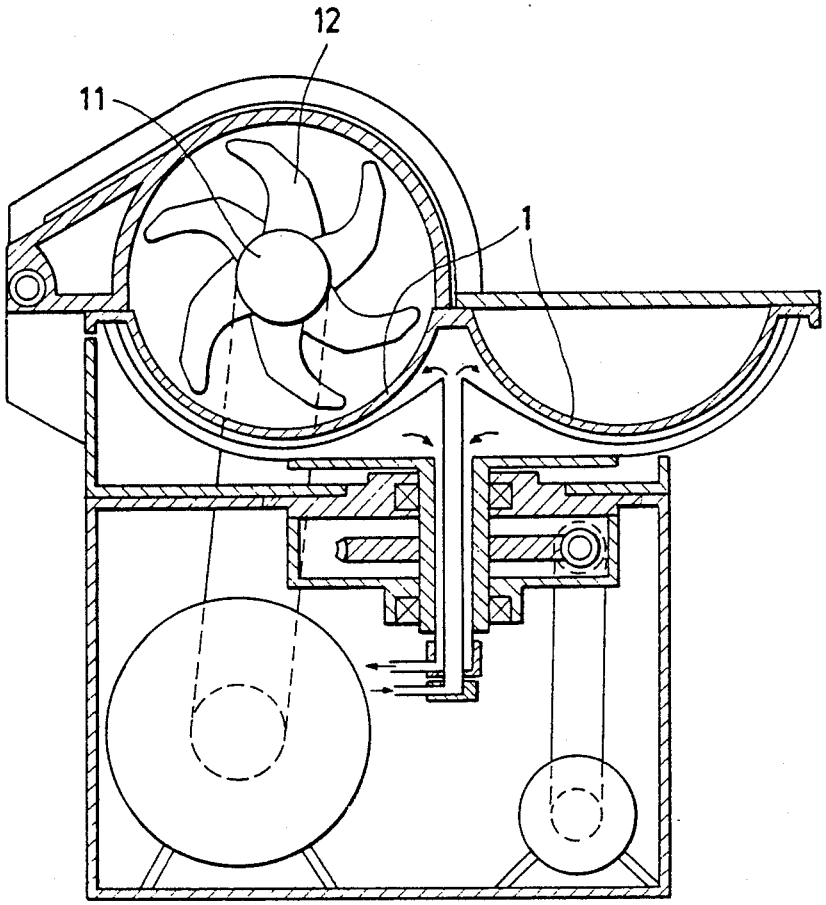
FIG. 1 is a complete view of an exemplary embodiment of the meat chopper of the invention.

Of the components of the meat chopper of the invention shown in FIG. 1, only those parts have been described which are essential for the invention.

The meat chopper according to FIG. 1 comprises a round pan 1 and a cutter head 10. The round pan has a circular cross-section and can be rotatably driven in an essentially horizontal plane.

Figure 2:
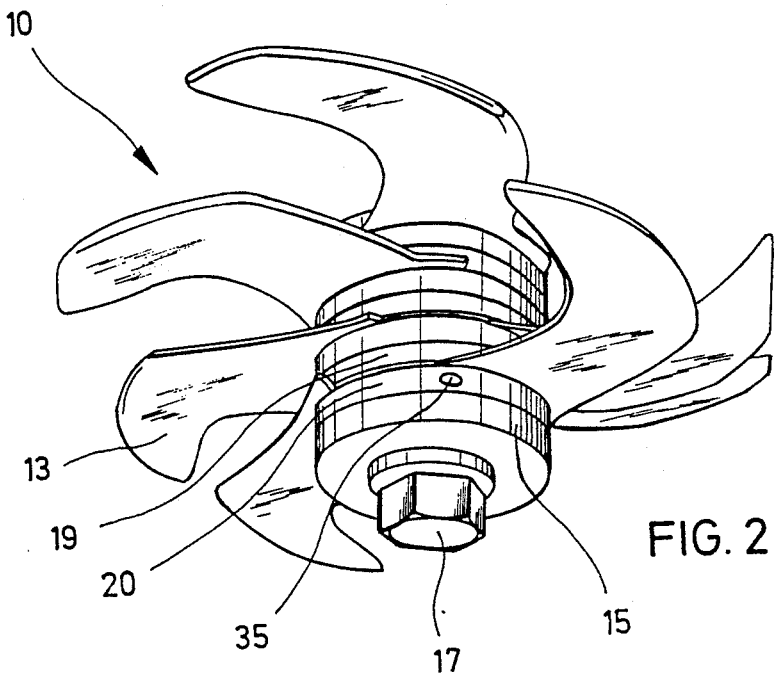
FIG. 2 is a perspective view of the cutter head used in the meat chopper of FIG. 1.

The cutter head 10 is attached in a non-rotatable and axially immovable manner to an essentially horizontal, rotatable shaft and includes three or four cutter head units 12 (four units according to FIGS. 2 and 3, three units according to FIG. 4) each with two cutters.

The shaft 11 is taper bore mounted and placed in such a way that the cutters 13 of the cutter head 10, as the latter rotates, essentially pass radially through the basin of the circular pan 1, while a certain distance necessary for the interaction of the cutters with the round pan wall for fine-chopping of the meat must be maintained between the cutter tips and the round pan wall.

The shaft 11 has in the area of its free end, i.e. in the area of the cutter head, a shaft section 11*a* with a reduced diameter, which is separated by means of a flange 14 from the remaining portion of the shaft 11 having a larger diameter. The cutter head units 12, which are placed in random order on the shaft section 11*a* between the flange 14 and a holding disk 15, are held axial and movable by means of a retaining nut 17, which is screwed onto the projecting free end 16 of the shaft section 11*a*. A washer 18 is placed between the flange 14 and the cutter head unit 12.

In addition to the cutter 13, each cutter head unit 12 comprises a base disk 19 and an adjusting disk 20, both of which have the same outside diameter as the holding disk 15. The cutters 13, which are held between the disks 19, 20 with their respective base, essentially are located diametrically opposed from one another in a plane which is radial to the shaft 11. As shown in FIG. 7, the widened base of each cutter 13 is formed in a roughly fork-like shape by a central recess.

The base disk 19 has an axial projection 22, which defines a through-hole 21 for the shaft section 11*a*, and which penetrates a through-hole 23 in the adjusting disk 20 and supports this adjusting disk 20, which is rotatably adjustable with respect to the base disk 19. The base disk 19 is connected non-rotatable with the shaft 11 by a longitudinal slot 24 located in the axial projection 22 and used to hold a spring, which is not shown.

In the assembled cutter head unit 12, the cutters 13 are supported at the base disk 19 by means of a respective bearing device 25; they are coupled with the adjusting disk 20 by means of a respective follower device 26.

Each bearing device 25 consists of a round through-hole 27 (FIG. 7) in a forked end of the cutter base, and of a pivot 28 at the base disk 19 for acceptance into the round hole 27. The pivot 28 is located at the disk surface bearing the axial projection 22, and its length essentially corresponds to the thickness of the adjusting disk 20. The pivots 28 required to support the two cutters 13 of a cutter head unit 12 are located on the base disk 19 with a 180° offset.

The follower device 26 (see especially FIG. 5) comprises a slot 29 in the fork-end of the cutter base located opposite the roundhole 27 (also see FIG. 7) and a pin 30 (see FIGS. 5 and 12) at the adjusting disk 20 for acceptance into slot 29. The pin diameter essentially corresponds to the width of the slot 29, in order to insure on the one hand, as little cross play as possible and, on the other hand, longitudinal movement of the pin in the slot 29. The length of the pin is such that it does not protrude from the slot 29. Lastly, as shown in the drawing, the slot is straight, but it can also run on a circular arc which is concentric to the round hole 27. The two pins 30 used for each cutter head unit 12 are located at a 180° offset from each other.

Furthermore, each cutter head unit 12 has two locking devices 31, which are located diametrically opposite from each other. Each locking device consists of a projection at the base disk 19, a slot 32 in the adjusting disk 20, and a locking element 33. The slot 32 serves to accept the projection and, as shown in the drawing, is straight; however, it can also run on a circular arc which is concentric to the through hole 23. In the exemplary embodiment shown, the pivot 28 serves as the projection. Corresponding to the length of the pivot, the slot 32 runs through the thickness of the adjusting disk 20. In order to assure free movement of the pivot 28 in the slot 32, and thus guarantee easy rotational adjustment of the adjusting disk 20 with respect to the base disk 20, the pivot diameter is somewhat less than the width of the slot. The two slots 32 in each adjusting disk 20 are so offset with respect to the pins 30 that, in the assembled cutter head unit 12, when the pins 30 pass through the slots 29 in the cutters 13, the slots 32 accept the pivots 28.

Each locking element 33 is designed as a stud bolt with hexagonal recess and can be screwed into a boring 35 with inside thread extending from the outer peripheral edge 34 of the adjusting disk 20 to the slot 32. The length of the stud bolt 33 is such that it can be screwed in projecting into the slot 32 (see FIG. 8); in the extreme, it can be screwed in so far that it presses the pivot 28 against the end of the slot 32 located across from the boring 35. The stud bolt 33 is screwed in by means of the hexagonal wrench 36.

Thus, in this construction version, the stud bolt 33 is designed as a locking and adjusting pin, so that the respective locking device 31 is simultaneously used for rotating the adjusting disk 20.

The two locking devices 31 of each cutter head unit 12 are contra-rotating since the borings 35 in the respective disk 20 are located at the opposite sides of the slots 32 in such a way that, as the locking elements 33 are screwed in, the cutters 13 are pivoted inward in an infinitely variable manner and the circuit of the cutter tips is consequently decreased. As soon as the stud bolts 33 have been locked against the respective pivots 28 by being screwed into the respective borings 35, they prevent the rotation of the adjusting disk 20 in the respective opposite direction. Thus, the adjusting disk 20 has been positively locked at the base disk in the respective selected adjustment position.

In order to secure the stud bolts 33 in the respective screwed-in position, a respective lock nut 37 with hexagonal recess has been provided (see FIG. 6).

For the purpose of exact balancing of the cutter head units 12, each base disk 19 has, at its outer face away from the adjusting disk 20, a number of pocket borings 38 with inside thread, which are located equidistant from each other near the circumference of the disk on a circular arc which is concentric to the disk 19, and which pocket borings 38 serve to accept balancing weights 39 in the form of stud bolts having the same dimensions.

The assembly of the cutter head 10 of the meat chopper of the invention is accomplished in the following manner. Each of the two cutters 13 of each cutter head unit 12 is placed with its round boring 27 on a respective one of the two pivots 28 of the base disk 19 in such a way that the fork-end with the elongated aperture 29 faces the fork-end with the round hole 27 of the respective other cutter 13. Then, with the help of stud bolts 33 screwed very lightly into the borings 35, and with lock nuts 37, the adjusting disk 20 is placed on the axial projection 22 of the base disk 19 in such a way that its bolts 30 engage the slots 29 of the cutters 13, and the pivots 28 simultaneously engage the slots 32.

The cutter head units 12 assembled in this manner are now pushed individually onto the shaft section 11*a*. Then, if required, the lock nuts 37 and the stud bolts 33 of both locking devices 31 are screwed outwardly inside the borings 35 by means of the hexagonal wrench 36 until it becomes possible to get both cutters 13 to rest against the round pan wall by rotating the adjusting disk 20. Subsequently, the stud bolt 33 of one of the two locking devices 31 is again screwed into the boring 35. As soon as it abuts the pivot 28, additional turning of the stud bolt 33 will rotationally adjust the adjusting disk 20 with respect to the base disk 19 in a counter-clockwise direction. The pins 30 of the adjusting disk 20, which engage the slots 29 of the cutters 13, simultaneously transfer the rotational adjustment of the adjusting disk 20 to both cutters 20, so that the latter are pivoted in an infinitely adjustable manner inward around the bearing devices 25, which increases the distance between the cutter points and the round pan wall. As soon as the correct distance has been obtained, the lock nut 37 is tightened by means of the hexagonal wrench 36 in order to secure the stud bolt 33.

The shaft is now rotated 180° in order to screw in the stud bolt of the second locking device 31 until positive locking to the pivot 28 has been achieved. In case the adjusting disk 20, which, until now, had been secured only by the stud bolt 33 of the first locking device 31 in one direction, has shifted position, it is merely necessary to screw in the stud bolt 33 of the second locking device 31 until both pivots are firmly positioned between both stud bolts 33. Both cutters 13 have now been adjusted in such a way that their points have the required distance from the round pan wall. The stud belt 33 of the second locking device 31 is secured by means of the lock nut 37.

The cutter head unit 12 adjusted in this manner is now pulled off the shaft 11*a* and placed on the balancing shaft of a device, which is not shown, in order to balance it in the traditional way by screwing balancing weights 39 into the pocket borings 38, or by removing the weights.

The balanced cutter head unit 12 is then pushed onto the shaft 11*a* of the meat chopper. The remaining cutter head units 12 are assembled, adjusted and balanced in the same manner and likewise pushed onto the shaft 11*a*. Fianlly, the holding disk 15 is positioned and the entire cutter head 10 is locked against axial displacement by screwing on the retaining nut 17.

Of course, it is also possible to adjust the assembled cutter head units 12 individually on an adjusting device (not shown). Such a device can consist of a receiving shaft for the cutter head unit 12 and of a detent placed at a certain distance from the receiving shaft. This detent, which consists of an adjusting screw at an adjusting head, can be adjusted at varying distances from the receiving shaft. If the cutters 13 are adjusted by means of the locking and adjusting device until they abut this detent, their cutter points are set at the required distance to the round pan wall. The adjusting head can have several adjusting screws and can be rotatable so that the distances between the receiving shaft and the adjusting screw can be changed quickly without moving the adjusting screw each time.

The invention is not limited to the above described embodiment. It is possible, for example, to use a bilaterally supported shaft instead of the floating shaft 11*a*.

It is also imaginable, for example, that the pocket boring for the balancing weights are machined into the edge of the disk so that the cutter head units can also be balanced on the shaft of the meat chopper.

I claim:

1. A meat chopper comprising a round pan (1), said pan having a circular cross-section and which can be rotated in an essentially horizontal plane; at least one cutter head (10), which is attached in a non-rotatable and axially immovable manner to an essentially horizontal, rotatable shaft (11), said cutter head having at least one cutter head unit (12); said cutter head unit having abase disk (19) having a through-hole mounting said base disk on said shaft, at least one adjusting disk (20) having a through-hole for mounting said adjusting disk on said shaft and which can be adjusted by rotating with respect to the base disk; and at least two cutter (13) having outer ends interacting with the wall of the round pan, said cutters disposed axially and radially between said disks, each of said cutters movable about a respective pivot disposed between said disks whereby pivotal movement of said cutter regulates the distance of said cutter outer end from said pan wall and said cutters connected to said adjusting disk by means of a follower device (26), whose spacing is determined by the respective pivot; said adjusting disk (20) being positively locked to the base disk (19) by means of at least one locking device (31) which can be operated from the outside.

2. A meat chopper according to claim 1 characterized in that the locking device (31) has at least one projection (28) at one of the disks (19 or 20) and one slotted hole (32) in the respective other disk (20 or 19, respectively) to accept the projection as well as at least one locking element (33) for engagement with the slotted hole (32) for positive support of the projection (28) at the respective other disk (19 or 20, respectively).

3. A meat chopper according to claim 2 characterized in that the slotted hole (32) extends through the thickness of the respective disk (19 or 20).

4. A meat chopper according to claim 2 characterized in that the slotted hole (32) is located in the adjusting disk 20 and the projection (28) is located at the base disk.

5. A meat chopper according to claim 2 characterized in that the bearing (25) includes a pivot (28) and the pivot (28) simultaneously serves as the projection (28) of the locking device (31).

6. A meat chopper according to claim 1 characterized in that two locking devices (31) are provided which essentially are located diametrically opposite from each other.

7. A meat chopper according to claim 1 characterized in that the locking device (31) simultaneously serves to turn the adjusting disk (20).

8. A meat chopper according to claim 7 characterized in that the locking device (33) is a locking and adjusting pin (33) which can be screwed into a borehole (35) which extends from the outer edge (34) of the circumference of the respective disk (20) to the slotted hole (32) and has an inside thread.

9. A meat chopper according to claim 8 characterized in that the locking and adjusting pin (33) is a screw with a hexagonal recessed hole.

10. A meat chopper according to claim 9 characterized in that the locking and adjusting pin element (33) can be secured by means of a counter screw (37).

11. A meat chopper according to claim 8 characterized in that the locking and adjusting pin element (33) can be secured by means of a counter screw (37).

12. A meat chopper according to claim 11 characterized in that the counter screw (37) has a hexagonal recessed hole.

13. A meat chopper according to claim 1 characterized in that the locking device comprises a multiplicity of boreholes through one of the disks, and at least one slot which is non-concentric to the through-hole for the shaft and has a width corresponding to similar boreholes and a slot in the respective other disk, and at least one locking pin for placement in one of the through-holes and the slot, respectively.

14. A meat chopper according to claim 13 characterized in that the balancing weights (39) are designed as screwpins and that at least the through-holes are designed as tapholes for accepting the screw pins.

15. A meat chopper according to claim 13 characterized in that the through-holes are designed to accept balancing weights (39).

16. A meat chopper according to claim 15 characterized in that each balancing weight (39) has essentially the same mass.

17. A meat chopper according to claim 1 characterized in that in at least one of the disks (19 or 20) includes pocket boreholes (38) for accepting balancing weights (39) said pocket boreholes being accessible from the outside.

18. A meat chopper according to claim 17 characterized in that the pocket boreholes (38) are located in the base disk (19).

19. A meat chopper according to claim 17 characterized in that the pocket boreholes (38) are located on a circular line near the edge of the disk.

20. A meat chopper according to claim 1 characterized in that the cutters of each cutter head unit are placed in two mutually parallel radial planes.

21. A meat chopper according to claim 20 characterized in that each cutter is placed between the base disk and one adjusting disk.

* * * * *